US009284632B2

(12) United States Patent
Kubota

(10) Patent No.: US 9,284,632 B2
(45) Date of Patent: Mar. 15, 2016

(54) STEEL FOR NITROCARBURIZING, NITROCARBURIZED STEEL PART, AND PRODUCING METHOD OF NITROCARBURIZED STEEL PART

(75) Inventor: Manabu Kubota, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 616 days.

(21) Appl. No.: 13/138,992

(22) PCT Filed: Jan. 25, 2011

(86) PCT No.: PCT/JP2011/051329

§ 371 (c)(1),
(2), (4) Date: Nov. 8, 2011

(87) PCT Pub. No.: WO2011/114775

PCT Pub. Date: Sep. 22, 2011

(65) Prior Publication Data

US 2012/0048427 A1 Mar. 1, 2012

(30) Foreign Application Priority Data

Mar. 16, 2010 (JP) ..... 2010-059230

(51) Int. Cl.

| | |
|---|---|
| ***C23C 8/80*** | (2006.01) |
| ***C22C 38/18*** | (2006.01) |
| ***C23C 8/00*** | (2006.01) |
| ***C22C 38/16*** | (2006.01) |
| ***C22C 38/08*** | (2006.01) |
| ***C22C 38/00*** | (2006.01) |
| ***C22C 38/14*** | (2006.01) |
| ***C22C 38/12*** | (2006.01) |
| ***C22C 38/02*** | (2006.01) |
| ***C21D 1/06*** | (2006.01) |
| ***C21D 1/28*** | (2006.01) |
| ***C21D 9/28*** | (2006.01) |
| ***C21D 9/32*** | (2006.01) |
| ***C21D 9/40*** | (2006.01) |
| ***C22C 38/04*** | (2006.01) |
| ***C22C 38/06*** | (2006.01) |
| ***C23C 8/24*** | (2006.01) |
| ***C23C 8/26*** | (2006.01) |
| ***C23C 8/32*** | (2006.01) |
| ***C23C 8/48*** | (2006.01) |
| ***C23C 8/74*** | (2006.01) |

(52) U.S. Cl.

CPC . *C22C 38/02* (2013.01); *C21D 1/06* (2013.01); *C21D 1/28* (2013.01); *C21D 9/28* (2013.01); *C21D 9/32* (2013.01); *C21D 9/40* (2013.01); *C22C 38/001* (2013.01); *C22C 38/04* (2013.01); *C22C 38/06* (2013.01); *C22C 38/14* (2013.01); *C23C 8/24* (2013.01); *C23C 8/26* (2013.01); *C23C 8/32* (2013.01); *C23C 8/48* (2013.01); *C23C 8/74* (2013.01); *C21D 2211/004* (2013.01); *C21D 2211/005* (2013.01)

(58) Field of Classification Search

CPC ..... C22C 38/02; C22C 38/001; C22C 38/04; C22C 38/06; C22C 38/14; C21D 1/06; C21D 1/28; C21D 9/28; C21D 9/32; C21D 9/40; C21D 2211/004; C21D 2211/005; C23C 8/24; C23C 8/26; C23C 8/32; C23C 8/48; C23C 8/74

See application file for complete search history.

(56) References Cited

U.S. PATENT DOCUMENTS

| | | | | |
|---|---|---|---|---|
| 5,312,493 | A * | 5/1994 | Masui et al. | 148/326 |
| 6,410,163 | B1 | 6/2002 | Suzuki et al. | |
| 2003/0034091 | A1 * | 2/2003 | Shimao et al. | 148/100 |

FOREIGN PATENT DOCUMENTS

| | | | | |
|---|---|---|---|---|
| CN | 1172918 | | 2/1998 | |
| JP | 05-059488 | | 3/1993 | |
| JP | 09-279295 | | 10/1997 | |
| JP | 10-306343 | | 11/1998 | |
| JP | 11-181518 | | 7/1999 | |
| JP | 11-229032 | | 8/1999 | |
| JP | 11-236646 | | 8/1999 | |
| JP | 11-302779 | | 11/1999 | |
| JP | 11-323482 | | 11/1999 | |
| JP | 11-335732 | | 12/1999 | |
| JP | 2000-169934 | | 6/2000 | |
| JP | 2000-204438 | | 7/2000 | |
| JP | 2000-345292 | | 12/2000 | |
| JP | 2002-069571 | | 3/2002 | |
| JP | 2002-069572 | | 3/2002 | |
| JP | 3353698 | | 12/2002 | |
| JP | 2004-003010 | | 1/2004 | |
| JP | 2004-244665 | * | 9/2004 | C22C 38/00 |
| JP | 2004-300472 | | 10/2004 | |

(Continued)

OTHER PUBLICATIONS

English Abstract and English Machine Translation of Fujita, et al. (JP 2004-244665) (Sep. 2, 2004).*

English Abstract and English Machine Translation of Kusumi, et al. (JP 2008-266721) (Nov. 6, 2008).*

Chinese Search Report dated Dec. 6, 2012, issued in corresponding Chinese Application No. 201180002039.1, with a partial English translation thereof.

International Search Report dated Apr. 26, 2011 issued in corresponding PCT Application No. PCT/JP2011/051329.

*Primary Examiner* — Jessee Roe

(74) *Attorney, Agent, or Firm* — Kenyon & Kenyon LLP

(57) ABSTRACT

Steel for nitrocarburizing includes, by mass %, C: 0% to less than 0.15%; Si: 0.01% to 1.00%; Mn: 0.01% to 1.00%; S: 0.0001% to 0.050%; Al: 0.0001% to 0.050%; Ti: more than 0.50% to 1.50%; N: 0.0005% to 0.0100%; and the balance consisting of Fe and inevitable impurities, in which P is limited to 0.050% or less; O is limited to 0.0060% or less; and the amount of Ti [Ti %], the amount of C [C %], the amount of N [N %], and the amount of S [S %] satisfy $0.48<[Ti\ \%]-47.9\times([C\ \%]/12+[N\ \%]/14+[S\ \%]/32)\leq 1.20$.

4 Claims, 5 Drawing Sheets

(56) References Cited

FOREIGN PATENT DOCUMENTS

| | | | | |
|---|---|---|---|---|
| JP | 2004-300473 | 10/2004 | | |
| JP | 2005-281857 | 10/2005 | | |
| JP | 2006-22351 | 1/2006 | | |
| JP | 2006-21937 | 8/2006 | | |
| JP | 3855418 | 9/2006 | | |
| JP | 3849296 | 11/2006 | | |
| JP | 2008-013807 | 1/2008 | | |
| JP | 2008-266721 | * 11/2008 | ..... | C21D 9/00 |
| JP | 4291941 | 7/2009 | | |

* cited by examiner

STEEL FOR NITROCARBURIZING, NITROCARBURIZED STEEL PART, AND PRODUCING METHOD OF NITROCARBURIZED STEEL PART

This application is a national stage application of International Application No. PCT/JP2011/051329, filed Jan. 25, 2011, which claims priority to Japanese Patent Application No. 2010-59230, filed Mar. 16, 2010, the content of which is incorporated herein by reference.

FIELD OF THE INVENTION

The present invention relates to steel for nitrocarburizing which is used for a steel part that is subjected to nitrocarburizing (soft-nitriding) before being used, a nitrocarburized steel part, and a producing method of a nitrocarburized steel part.

DESCRIPTION OF RELATED ART

In most cases, power transmission parts (for example, gears, bearings, CVT sheaves, shafts, or the like) used for industrial machinery, such as automobiles, construction machinery, agricultural machinery, or windmills for power generation, are subjected to a surface-hardening treatment before being used for the purpose of the improvement of the fatigue characteristics, wear resistance, or the like of the parts. Among a variety of surface-hardening treatments, carburizing is superior to other surface-hardening treatments from the standpoint of the hardness of the surface of parts, the depth of a hardened layer (the case depth), productivity, or the like, and thus can be applied to an extremely large number of parts. For example, in the case of the parts of gears and bearings, generally, medium carbon alloy steel, such as SCM 420, SCR 420, or SNCM 220 in JIS, is subjected to a mechanical process, in which the medium carbon alloy steel is made into a predetermined shape by hot forging, cold forging, cutting, or a combination thereof, and then is subjected to carburizing or carbonitriding. However, in the carburizing, since a part is heated and held for a long time at about 930° C., and then is quenched, the part is deformed while being heated and held at a high temperature. In addition, phase transformation, such as austenite transformation during temperature rise or martensite transformation during quenching, is also accompanied by a change in volume. As such, since a part is subjected to heat treatment-induced deformation after carburizing, the part which has undergone carburizing has a disadvantage of inevitably degraded precision in comparison to a part which has been subjected to a mechanical process.

In a nitrocarburizing, since heating is performed in the ferrite region of $A_1$ temperature or lower which is lower than the heating temperature in a carburizing, heat treatment-induced deformation is extremely small, compared with the carburizing. In addition, recently, there has been demand for the improvement of fatigue strength of a tooth flank in order to improve the performance of automobiles. Particularly, since the temperature of the tooth flank of a gear rises up to about 300° C. while the gear is being used, it is effective for the improvement of fatigue strength of a tooth flank to improve the hardness at 300° C. (or the hardness after annealing at 300° C.; hereinafter referred to as '300° C.-tempered hardness'). When a carburized gear (a carburized part) is exposed to a temperature higher than the annealing temperature (generally about 150° C.), martensite is tempered so that the hardness is lowered. However, a part, which has been subjected to an ordinary nitrocarburizing, has already been exposed to a temperature of 400° C. or higher during the nitrocarburizing, and therefore, even when the temperature rises up to the vicinity of 300° C. while the part is being used, the hardness is hardly lowered. Therefore, a part which has been subjected to nitrocarburizing is also advantageous from the standpoint of the fatigue strength of the tooth flank.

However, generally, a part which has been subjected to nitrocarburizing has a disadvantage in that the depth of the hardened layer is less than that of a part which has been subjected to a carburizing. Here, the "hardened layer (precipitation-hardened layer)" is not a compound layer on the outermost surface, but a "diffusion layer" which is located in a region on the side of the center of the part compared with the compound layer and contains nitrogen diffused by a nitriding. Therefore, in order for the hardened layer to have the same depth as that of a part which has been subjected to a carburizing, it is necessary to perform nitrocarburizing for an extremely long time. As a result, the nitrocarburizing becomes inferior from the standpoint of productivity and costs, and thus has not become widespread.

As steel for nitrocarburizing which is excellent in terms of fatigue characteristics, for example, Patent Citations 1 to 5 disclose techniques that form nitride with elements, such as Cr, Ti, V, or Mo during nitrocarburizing in order to obtain a hardened layer. However, in these techniques, materials contain a large amount of carbon, and therefore alloy elements, which are supposed to form nitride, are fixed in the form of carbide, which makes the degrees of hardening of the hardened layers and the depths of the hardened layers insufficient. Patent Citations 6 and 7 disclose steel for nitrocarburizing which contains a relatively small amount of carbon, in which, in order to obtain a hardened layer, a relatively large amount of Al is added, and the nitride of Al is formed by nitrocarburizing. As such, when a large amount of Al is added, the hardness of a hardened layer (diffusion layer) increases, but the depth of the hardened layer becomes significantly reduced. Therefore, in these techniques, it is difficult to obtain a hardened layer which is thick enough to replace carburizing. Patent Citation 8 discloses that the amount of carbon is relatively reduced, and carbides of elements, such as Mo or Ti, are formed as precipitates, thereby increasing the fatigue strength of a part. However, since the amount of Ti added is small, the degree of hardening and the depth of a hardened layer are insufficient. Patent Citations 9 to 11 disclose that the fatigue strength of a part is enhanced using the precipitation of Cu in addition to the precipitation of nitrides. However, since the amount of Ti added is small, the degree of hardening and the depth of a hardened layer are insufficient. Patent Citation 12 discloses that an extremely large amount of elements, such as Cu, Ni, or Al, is added to steel, and intermetallic compounds are precipitated in the central portion in addition to nitrides in the surface layer portion, thereby increasing the fatigue strength. However, since the amount of nitride-forming elements is extremely large, there is a problem in that the depth of a hardened layer becomes thin.

PATENT CITATION

[Patent Citation 1] Japanese Patent No. 3849296
[Patent Citation 2] Japanese Patent No. 3353698
[Patent Citation 3] Japanese Unexamined Patent Application, First Publication No. H11-229032
[Patent Citation 4] Japanese Patent No. 3855418
[Patent Citation 5] Japanese Unexamined Patent Application, First Publication No. 2005-281857

[Patent Citation 6] Japanese Unexamined Patent Application, First Publication No. H9-279295

[Patent Citation 7] Japanese Unexamined Patent Application, First Publication No. H5-59488

[Patent Citation 8] Japanese Unexamined Patent Application, First Publication No. 2004-3010

[Patent Citation 9] Japanese Patent No. 4291941

[Patent Citation 10] Japanese Unexamined Patent Application, First Publication No. 2002-69571

[Patent Citation 11] Japanese Unexamined Patent Application, First Publication No. H10-306343

[Patent Citation 12] Japanese Unexamined Patent Application, First Publication No. 2000-345292

SUMMARY OF THE INVENTION

Problems to be Solved by the Invention

The present invention has been made in consideration of the above situation, and an object of the present invention is to provide steel for nitrocarburizing which can obtain the hardness and depth of a hardened layer, which are comparable to those of a carburized part, after nitrocarburizing so as to obtain a surface-hardened steel part which shows extremely small heat treatment-induced deformation in comparison to a carburized part and thus can replace a carburized part. In addition, another object of the present invention is to provide a nitrocarburized steel part which can replace a carburized part and has a high working accuracy, and a producing method thereof.

Methods for Solving the Problem

The inventors found that, by nitrocarburizing in a temperature range of 550° C. to 650° C. on a steel in which the amount of C is limited to less than 0.15%, by mass %, and more than 0.50% of the solute Ti in steel is included, the solute Ti easily combines with N so as to precipitate nitrides, and a precipitation-hardened layer (diffusion layer) can be efficiently hardened. In addition, the inventors found that the effect becomes more significant by nitrocarburizing at a higher temperature, and the same effect as that of a nitrocarburizing at a high temperature can be obtained by adding a diffusion treatment after the nitrocarburizing. The inventors completed the present invention based on the above findings, and the summary is as follows:

(1) Steel for nitrocarburizing according to a first aspect of the present invention includes, by mass %, C: 0% to less than 0.15%; Si: 0.01% to 1.00%; Mn: 0.01% to 1.00%; S: 0.0001% to 0.050%; Al: 0.0001% to 0.050%; Ti: more than 0.50% to 1.50%; N: 0.0005% to 0.0100%; and the balance consisting of Fe and inevitable impurities, in which P is limited to 0.050% or less; O is limited to 0.0060% or less; and the amount of Ti [Ti %], the amount of C [C %], the amount of N [N %], and the amount of S [S %] satisfy $0.48<[Ti\ \%]-47.9\times([C\ \%]/12+[N\ \%]/14+[S\ \%]/32)\leq 1.20$.

(2) The steel for nitrocarburizing according to (1) may further include at least one of, by mass %, Cr: 0.01% to less than 0.30%; Mo: 0.01% to 1.00%; V: 0.005% to 0.50%; Nb: 0.005% to 0.10%; Cu: 0.05% to 2.00%; Ni: 0.05% to less than 2.00%; and B: 0.0005% to 0.0050%.

(3) A nitrocarburized steel part according to an aspect of the present invention is a steel part which has been subjected to a nitrocarburizing, including a nitrocarburized portion present on the surface of the steel part; and a non-nitrocarburized portion surrounded by the nitrocarburized portion, in which the non-nitrocarburized portion includes, by mass %, C: 0% to less than 0.15%; Si: 0.01% to 1.00%; Mn: 0.01% to 1.00%; S: 0.0001% to 0.050%; Al: 0.0001% to 0.050%; Ti: more than 0.50% to 1.50%; N: 0.0005% to 0.0100%; and the balance consisting of Fe and inevitable impurities, in which P is limited to 0.050% or less; O is limited to 0.0060% or less; and the amount of Ti [Ti %], the amount of C [C %], the amount of N [N %], and the amount of S [S %] satisfy $0.48<[Ti\ \%]-47.9\times([C\ \%]/12+[N\ \%]/14+[S\ \%]/32)\leq 1.20$; and, in the nitrocarburized portion, a hardness HV at a depth of 50 μm away from the surface is 600 to 1050, a depth where a hardness HV becomes 550 is 0.4 mm or more, and a thickness of an acicular compound layer is 30 μm or less.

(4) In the nitrocarburized steel part according to (3), the non-nitrocarburized portion may further include at least one of, by mass %, Cr: 0.01% to less than 0.30%; Mo: 0.01% to 1.00%; V: 0.005% to 0.50%; Nb: 0.005% to 0.10%; Cu: 0.05% to 2.00%; Ni: 0.05% to less than 2.00%; and B: 0.0005% to 0.0050%.

(5) In a producing method of a nitrocarburized steel part according to an aspect of the present invention, steel having the chemical composition according to (1) or (2) is processed into a desired product shape, and then is subjected to a nitrocarburizing while being held in 550° C. to 650° C. for 60 minutes or longer.

(6) In the producing method of the nitrocarburized steel part according to (5), the steel may be further held in 580° C. to 700° C. for 5 minutes or longer in an atmosphere other than the nitriding atmosphere after the nitrocarburizing.

Effects of the Invention

According to the present invention, it is possible to provide steel for nitrocarburizing which can obtain the hardness and depth of a hardened layer, which are comparable to those of a carburized part, after nitrocarburizing so as to obtain a surface-hardened steel part which shows an extremely small heat treatment-induced deformation in comparison to a carburized part and thus can replace a carburized part. Furthermore, according to the present invention, it is possible to provide a nitrocarburized steel part which can replace a carburized part and has a high working accuracy and a producing method thereof.

DETAILED DESCRIPTION OF THE INVENTION

Figure 1A:
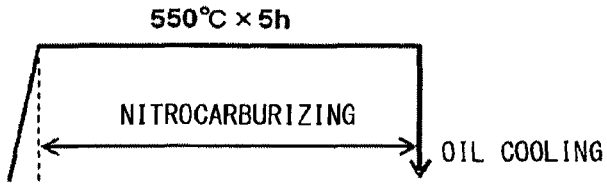
FIG. 1A is a view showing the conditions of a nitrocarburizing in an example.

The inventors carried out thorough studies regarding a variety of factors that affect the hardening behaviors of a hardened layer during nitrocarburizing and obtained the following findings.

(a) Both Al and Cr, which were added to steel for nitrocarburizing as the main chemical element in the past, improve the hardness of a hardened layer, but significantly reduce the depth of the hardened layer. Therefore, the addition of a more than necessary amount of Al and Cr is disadvantageous from the standpoint of the depth of the hardened layer.

(b) When a predetermined amount or more of Ti of a solute in a solid solution (solute Ti) is present in steel, since Ti easily combines with N during nitrocarburizing so as to form a cluster of Ti and N or precipitate in the form of TiN, it is possible to harden and deepen a precipitation-hardened layer (diffusion layer) and to efficiently perform nitrocarburizing. Ti in steel has such an effect as a solute dissolved in steel. Therefore, when Ti combines with carbon, sulfur, and nitrogen in the form of $Ti_4C_2S_2$, TiC, TiN, or Ti(CN), or a large amount of solute carbon and solute nitrogen, which have a possibility of combining with Ti, is present in steel in advance before nitrocarburizing, such an effect cannot be obtained.

(c) When the temperature of nitrocarburizing increases, the diffusion of nitrogen is accelerated in the diffusion layer, and the generation of TiN clusters and the precipitation of TiN are accelerated. In addition, since it is difficult to make TiN coarse even at a high temperature, it is difficult to soften the hardened layer even when the temperature of the nitrocarburizing increases. Thereby, both the hardness of the hardened layer and the depth of the hardened layer can be satisfied. In contrast, since the size of AlN and CrN increases easily when the temperature of nitrocarburizing increases, the hardness of the hardened layer is lowered, which is disadvantageous from the standpoint of satisfying both the hardness of the hardened layer and the depth of the hardened layer.

(d) When a part is heated and held subsequent to the nitrocarburizing, or a part is reheated subsequent to cooling to a temperature, which is lower than the temperature of the nitrocarburizing, after the nitrocarburizing, since nitrogen diffuses inside the part, it is possible to further increase the depth of the hardened layer.

The inventors completed the present invention based on the above findings.

Hereinafter, an embodiment of the present invention will be described in detail. Firstly, the reasons why the chemical composition is limited will be described. Here, the '%' in the amounts of the chemical elements indicates 'mass %'.

C: 0% to less than 0.15%

In order to secure solute Ti in steel, it is desirable to reduce the amount of C as much as possible. Particularly, when the amount of C is large, since the solute Ti is fixed in the form of TiC, it is necessary to increase the amount of Ti. Therefore, in order to effectively use the added Ti for nitrocarburizing, it is necessary to set the amount of C to less than 0.15%. In addition, when the amount of C is reduced to a predetermined value or lower, the influence on the fixation (stabilization) of solute Ti become substantially negligible depending on the amount of Ti, the amount of C is preferably set to less than 0.12%, and more preferably to less than 0.10%. The lower limit of the amount of C is 0%. However, since the reduction of the amount of C leads to a significant increase in costs, the amount of C is preferably set to 0.001% or more, and more preferably to 0.005% or more.

Si: 0.01% to 1.00%

Si is an element that increases the hardness of ferrite by solid solution strengthening. When the amount of Si is 0.01% or more, it is possible to sufficiently develop the effect of solid solution strengthening. However, when more than 1.00% of Si is added to steel, nitrides are formed in the diffusion layer during nitrocarburizing, and the depth of the hardened layer becomes thinner. Therefore, it is necessary to set the amount of Si to 0.01% to 1.00%. In order to further increase the hardness of ferrite in consideration of the amounts of other elements for solid solution strengthening, the amount of Si is preferably 0.015% or more, and is more preferably 0.02% or more. In addition, in order to reduce the amount of Si to an amount where the formation of nitrides during nitrocarburizing be ignored, the amount of Si is preferably 0.80% or less, and is more preferably 0.50% or less.

Mn: 0.01% to 1.00%

Mn is an element that increases the hardness of ferrite by solid solution strengthening. When the amount of Mn is 0.01% or more, it is possible to sufficiently develop the effect of solid solution strengthening. However, when more than 1.00% of Mn is added to steel, nitrides are formed in the diffusion layer during nitrocarburizing, and the depth of the hardened layer becomes thinner. Therefore, it is necessary to set the amount of Mn to from 0.01% to 1.00%. In order to further increase the hardness of ferrite in consideration of the amounts of other elements for solid solution strengthening, the amount of Mn is preferably 0.05% or more, and is more preferably 0.10% or more. In addition, in order to reduce the amount of Mn to an amount where the formation of nitrides during nitrocarburizing is negligible, the amount of Mn is preferably 0.80% or less, and is more preferably 0.50% or less.

S: 0.0001% to 0.050%

S combines with Mn so as to form MnS, and has an effect of improving machinability with an increase in the amount of S added. Therefore, 0.0001% or more of S is included in steel. However, when more than 0.050% of S is added to steel, there are cases in which coarse precipitates having no contribution to machinability, such as $Ti_4C_2S_2$, are formed such that workability is degraded. Furthermore, since a part of Ti is fixed in the form of $Ti_4C_2S_2$, the amount of solute Ti which contributes to precipitation strengthening during nitrocarburizing is reduced. Therefore, it is necessary to set the amount of S to from 0.0001% to 0.050%. When it is necessary to sufficiently secure machinability, the amount of S is preferably 0.0002% or more, and is more preferably 0.0005% or more. In addition, in order to sufficiently suppress the formation of coarse precipitates and sufficiently secure workability, the amount of S is preferably 0.040% or less, and is more preferably 0.030% or less. In addition, when the amount of S is reduced to a predetermined value or less, since the effect on the fixation of solute Ti is substantially negligible depending on the amount of Ti, the amount of S is most preferably 0.015% or less.

Al: 0.0001% to 0.050%

Al is an effective element for deoxidizing steel. Therefore, it is necessary to set the amount of Al to 0.0001% or more. However, when more than 0.050% of Al is added to steel, nitrides are formed in the diffusion layer during nitrocarburizing so that the hardness of the hardened layer increases significantly, but the depth of the hardened layer decreases significantly. Therefore, it is necessary to set the amount of Al to be in a range of from 0.0001% to 0.050%. In addition, in order to reduce the amount of Al to an amount where the formation of nitrides during nitrocarburizing is negligible, the amount of Al is preferably 0.040% or less, and is more preferably 0.030% or less.

Ti: more than 0.50% to 1.50%

When more than 0.50% of Ti is present in steel as a solute, since Ti easily combines with N during nitrocarburizing so as to form clusters of Ti and N or precipitate in the form of TiN, it is possible to harden and deepen the precipitation-hardened layer (diffusion layer) and to efficiently perform nitrocarburizing. Ti in steel has such an effect when Ti is dissolved as a solute in the solid solution. When Ti combines with carbon, sulfur, and nitrogen in the form of $Ti_4C_2S_2$, TiC, TiN, or Ti(CN) in advance before nitrocarburizing, such an effect cannot be obtained, and therefore it is necessary to add a relatively large amount of Ti to steel. However, when more than 1.50% or Ti is added to steel, the hardness of the hardened layer increases more than is necessary, and the depth of the hardened layer becomes thin. Therefore, it is necessary to set the amount of Ti to be in a range of from more than 0.50% to 1.50%. In order to make the precipitation-hardened layer (diffusion layer) harder and deeper, the amount of Ti is preferably 0.60% or more, and is more preferably 0.70% or more. In addition, in order to sufficiently secure the depth of the hardened layer under predetermined conditions of the nitrocarburizing, the amount of Ti is preferably 1.20% or less, and is more preferably 1.00% or less.

N: 0.0005% to 0.0100%

N combines with nitride-forming elements, such as Al or Ti, in steel so as to form nitrides. However, in order to secure solute Ti in steel, it is desirable to reduce the amount of N as much as possible. Particularly, when the amount of N is large, since the solute Ti is fixed in the form of TiN, it is necessary to increase the amount of Ti. Therefore, in order to effectively use the added Ti for nitrocarburizing, it is necessary to set the amount of N to 0.0100% or less. In addition, since the reduction of the amount of N, which is inevitably included, leads to a significant increase in costs, it is necessary to set the amount of N to 0.0005% or more. When the amount of N is reduced to a predetermined value or lower, the influence on the fixation of the solute Ti become substantially negligible depending on the amount of Ti, the amount of N is preferably 0.008% or less, and is more preferably to 0.0060% or less. In addition, since the reduction of the amount of N leads to a significant increase in costs, the amount of N is preferably 0.0010% or more, and is more preferably 0.0015% or more.

P: 0.050% or less

P is included in steel as an impurity and segregates in grain boundaries so as to make the grain boundaries brittle and cause grain boundary cracking. Therefore, it is desirable to reduce the amount of P as much as possible. As a result, it is necessary to set the amount of P to 0.050% or less. In order to further reliably prevent grain boundary cracking, the amount of P is preferably 0.030% or less, and is more preferably 0.015% or less. In addition, the lower limit of the amount of P is 0%.

O: 0.0060% or less

O is inevitably included in steel and forms oxide-based inclusions. When the amount of O is large, since the number of large inclusions, which act as the starting point of fatigue fracture, increases, and the large inclusions cause the degradation of fatigue characteristics, it is desirable to reduce the amount of O as much as possible. Therefore, it is necessary to limit the amount of O to 0.0060% or less. In order to further improve the fatigue characteristics, the amount of O is preferably limited to 0.0050% or less, and more preferably limited to 0.0040% or less. In addition, the lower limit of the amount of O is 0%.

Furthermore, in addition to the above chemical elements, the reasons why optionally added chemical elements are limited will be described.

Cr: 0.01% to less than 0.30%

Cr is an element that generates nitrides during nitrocarburizing so as to harden the hardened layer. Therefore, in order to further increase the hardness of the hardened layer, the amount of Cr needs to be 0.01% or more. However, when 0.30% or more of Cr is added to steel, the amount of nitrides generated becomes excessive, and the depth of the hardened layer is significantly reduced. Therefore, it is necessary to set the amount of Cr to be in a range of from 0.01% to less than 0.30%. Meanwhile, it is necessary to increase the added amount of alloy elements that form nitrides, such as Al, Cr, or Ti, in order to increase the hardness of the hardened layer. However, the depth of the hardened layer is reduced as the added amount of the alloy elements increases. The depth of the hardened layer in a nitrocarburized steel, to which is Cr is added, becomes small in comparison to a nitrocarburized steel, to which Ti is added, when the effect of the addition of Cr is compared with the effect of the addition of Ti using the Cr-added nitrocarburized steel and the Ti-added nitrocarburized steel, the depth of which is the same hardness as the depth of the Cr-added nitrocarburized steel. Therefore, increasing the effect of the addition of Ti by limiting the added amount of Cr is advantageous for satisfying both the hardness and depth of the hardened layer. As a result, the amount of Cr is preferably less than 0.15%. Particularly, when an amount of Cr where the reduction of the depth of the hardened layer is negligible is considered, the amount of Cr is more preferably less than 0.10%.

Mo: 0.01% to 1.00%

Mo is an effective element to harden the hardened layer by generating nitrides during nitrocarburizing. Therefore, in order to further increase the hardness of the hardened layer, the amount of Mo needs to be 0.01% or more. However, when more than 1.00% of Mo is added to steel, the amount of nitrides generated becomes excessive, and the depth of the hardened layer is significantly reduced. Therefore, it is necessary to set the amount of Mo in a range of from 0.01% to 1.00%. In order to further increase the hardness of the hardened layer, the amount of Mo is preferably 0.05% or more, is more preferably 0.10% or more, and is most preferably 0.15% or more. In addition, in order to further reliably secure the depth of the hardened layer, the amount of Mo is preferably 0.80% or less, and is more preferably 0.60% or less.

V: 0.005% to 0.50%

V is an element that hardens the hardened layer by generating nitrides during nitrocarburizing. Therefore, in order to further increase the hardness of the hardened layer, the amount of V needs to be 0.005% or more. However, when more than 0.50% of V is added to steel, the amount of nitrides generated becomes excessive, and the depth of the hardened layer is significantly reduced. Therefore, it is necessary to set the amount of V in a range of from 0.005% to 0.50%. In order to further increase the hardness of the hardened layer, the amount of V is preferably 0.01% or more, and is more preferably 0.05% or more. In addition, in order to further reliably secure the depth of the hardened layer, the amount of V is preferably 0.40% or less, and is more preferably 0.30% or less.

Nb: 0.005% to 0.10%

Nb is an element that hardens the hardened layer by generating nitrides during nitrocarburizing. Therefore, in order to further increase the hardness of the hardened layer, the amount of Nb needs to be 0.005% or more. However, when more than 0.10% of Nb is added to steel, the amount of nitrides generated becomes excessive, and the depth of the hardened layer is significantly reduced. Therefore, it is necessary to set the amount of Nb in a range of from 0.005% to 0.10%. In order to further increase the hardness of the hardened layer, the amount of Nb is preferably 0.008% or more, and is more preferably 0.010% or more. In addition, in order to further reliably secure the depth of the hardened layer, the amount of Nb is preferably 0.080% or less, and is more preferably 0.050% or less.

Cu: 0.05% to 2.00%

Cu is precipitated during nitrocarburizing, and has an effect of increasing the core hardness of a part. When the amount of Cu is 0.05% or more, the effect is exhibited. However, when more than 2.00% of Si is added to steel, ductility is degraded in a high temperature range of 1000° C. or higher, and the yield is lowered during continuous casting and hot rolling. Therefore, it is necessary to set the amount of Cu to be in a range of from 0.05% to 2.00%. In order to further increase the core hardness of a part, the amount of Cu is preferably 0.08% or more, and is more preferably 0.10% or more. In addition, in order to suppress the lowering of the yield during continuous casting and hot rolling, the amount of Cu is preferably 1.50% or less, and is more preferably 1.00% or less. Meanwhile, when Cu is added, it is desirable to add Ni to the extent that the amount of Ni becomes half or more of the amount of Cu in order to improve ductility in a high temperature range.

Ni: 0.05% to less than 2.00%

Since Ni has an effect of improving the toughness of steel, Ni is added to steel when it is necessary to improve the toughness of a part. Therefore, in order to improve the toughness of steel, the amount of Ni needs to be 0.05% or more. In addition, when Cu is added, since Ni has an action of reducing hot embrittlement induced by Cu, it is desirable to add Ni to the extent that the amount of Ni becomes half or more of the amount of Cu. However, when Ni is excessively added to steel, the costs for steel increases, and therefore it is necessary to set the amount of Ni to less than 2.00%. In order to further reliably improve the toughness of steel, the amount of Ni is preferably 0.20% or more, and is more preferably 0.40% or more. In addition, when the costs for steel are taken into account in manufacturing a nitrocarburized steel part, the amount of Ni is preferably 1.50% or less, and is more preferably 1.00% or less.

B: 0.0005% to 0.0050%

B is an element that segregates in grain boundaries so as to contribute to grain boundary strengthening. When the amount of B is 0.0005% or more, the effect is developed. However, even when more than 0.0050% of B is added to steel, the effect is saturated at the amount of B of 0.0050%. Therefore, it is necessary to set the amount of B in a range of from 0.0005% to 0.0050%. In order to further strengthen grain boundaries, the amount of B is preferably 0.0008% or more, and is more preferably 0.0010% or more. In addition, in order to sufficiently develop the effect per unit mass of B, which is added for grain boundary strengthening, the amount of B is preferably 0.0040% or less, and is more preferably 0.0025% or less.

In the embodiment, in addition to the above chemical elements, it is possible to include chemical elements, such as Ca, Zr, Mg, Te, Zn, or Sn, within a range in which the effect of the present invention is not impaired. For example, each of Ca, Zr, Mg, Te, Zn, and Sn may be included in steel in an amount of from 0.0002% to 0.0050%.

Furthermore, in the embodiment, Ti is added to steel and the amounts of C, N, and S in steel are limited so that the amount of Ti [Ti %], the amount of C [C %], the amount of N [N %], and the amount of S [S %] satisfy the Equation (1) below.

$$0.48<[\text{Ti }\%]-47.9\times([\text{C }\%]/12+[\text{N }\%]/14+[\text{S }\%]/32)\leq 1.20 \quad (1)$$

As described above, when a predetermined amount or more of solute Ti is present in steel, since Ti easily combines with N during nitrocarburizing so as to form a cluster of Ti and N or precipitate in the form of TiN, it is possible to harden and deepen the precipitation-hardened layer (diffusion layer) and to efficiently perform nitrocarburizing. Since the amount of Ti dissolved as a solute in a solid solution (the amount of solute Ti) is obtained by subtracting the amount of Ti used to generate the compounds of $Ti_4C_2S_2$, TiC, or TiN from the total amount of Ti, the amount of solute Ti can be expressed as [Ti %]−47.9×([C %]/12+[N %]/14+[S %]/32) in consideration of the atomic weight of Ti, C, N, and S. When the amount of solute Ti is small, the hardness of the hardened layer is insufficient. However, when Ti is excessively added to steel, there is a tendency that the amount of nitrides generated becomes excessive, and the depth of the hardened layer is reduced. Therefore, it is necessary to set the amount of solute Ti ([Ti %]−47.9×([C %]/12+[N %]/14+[S %]/32)) in a range of more than 0.48% to 1.20%. In order to further reliably increase the depth of the hardened layer, the amount of solute Ti is preferably 1.00% or less, and is more preferably 0.80% or less. In order to further increase the hardness of the hardened layer, the amount of solute Ti is preferably more than 0.50%, is more preferably more than 0.55%, and is most preferably more than 0.60%. Here, the '[Ti %], [C %], [N %], and [S %]' in the Equation (1) are the mass percentages (by mass %) of the respective elements (Ti, C, N, and S) included in steel.

In addition, the nitrocarburized steel part according to an embodiment of the present invention is manufactured by performing nitrocarburizing on the steel for nitrocarburizing according to the embodiment, and has a nitrocarburized portion present on the surface of the part and a non-nitrocarburized portion present inward of the nitrocarburized portion. Therefore, the non-nitrocarburized portion is surrounded by the nitrocarburized portion, and the chemical composition in the non-nitrocarburized portion is within the range of the chemical composition of the steel for nitrocarburizing according to the embodiment. In addition, the nitrocarburized portion has a hardened layer (diffusion layer). Furthermore, in the nitrocarburized steel part of the embodiment, it is necessary that the nitrocarburized portion has a hardness HV of 600 to 1050 at a depth of 50 μm away from the surface (the distance from the surface of the nitrocarburized steel part in a direction perpendicular to the surface and toward the core of the nitrocarburized steel part) (the hardness at a depth of 50 μm), and a depth where a hardness HV becomes 550 in the nitrocarburized portion is 0.4 mm or more.

All of the conditions are conditions necessary to obtain fatigue strength that is comparable to that of a carburized part. When the hardness HV at a depth of 50 μm away from the surface of a part is less than 600, desired fatigue strength cannot be obtained at the tooth flank and the dedendum. In addition, when the hardness HV becomes 550 at a depth of less than 0.4 mm, desired fatigue strength cannot be obtained at the dedendum, and fracture starting from the inside, such as spalling, becomes liable to occur. On the other hand, when the hardness HV at a depth of 50 μm away from the surface of a part exceeds 1050, the toughness and ductility of the hardened layer are lowered, and there are cases in which cracks occur in the hardened layer due to residual stress caused by nitrocarburizing. Therefore, it is necessary to suppress the hardness HV at a depth of 50 μm away from the surface of a part to 1050. In order to further increase the fatigue strength at the tooth flank, the hardness HV at a depth of 50 μm is preferably 650 or higher. In addition, in order to reliably prevent the occurrence of cracks in the hardened layer even in nitrocarburizing under stricter conditions, the hardness HV at a depth of 50 μm is preferably 1000 or lower, and is more preferably 900 or lower. Moreover, in order to reliably prevent the occurrence of fracture starting from the inside even under stricter conditions for use, the depth where the hardness HV becomes 550 is preferably 0.42 mm or more. Furthermore, since the effect of obtaining the predetermined fatigue strength at the dedendum is saturated, the depth where the hardness HV becomes 550 is preferably 1.5 mm or less.

Figure 2A:
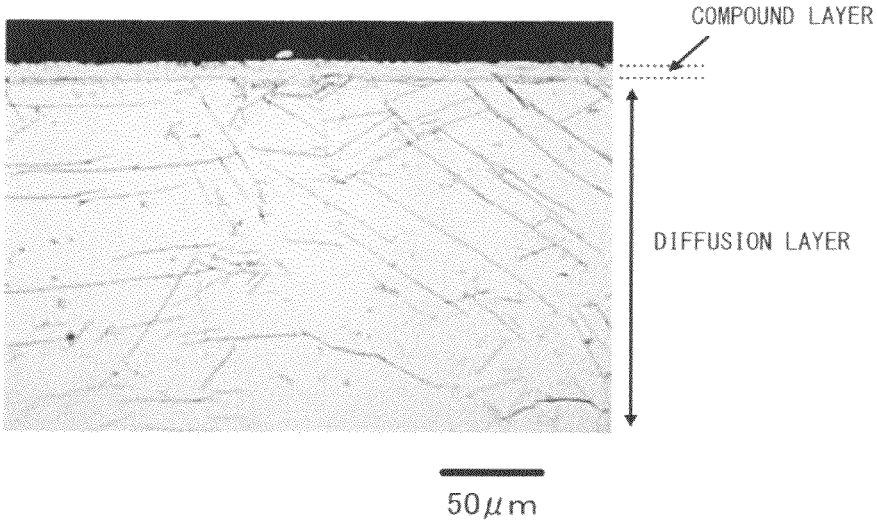
FIG. 2A is a microscope photograph showing an example of the cross-sectional microstructure of the surface layer portion in a steel part after an ordinary nitrocarburizing.
Figure 2B:
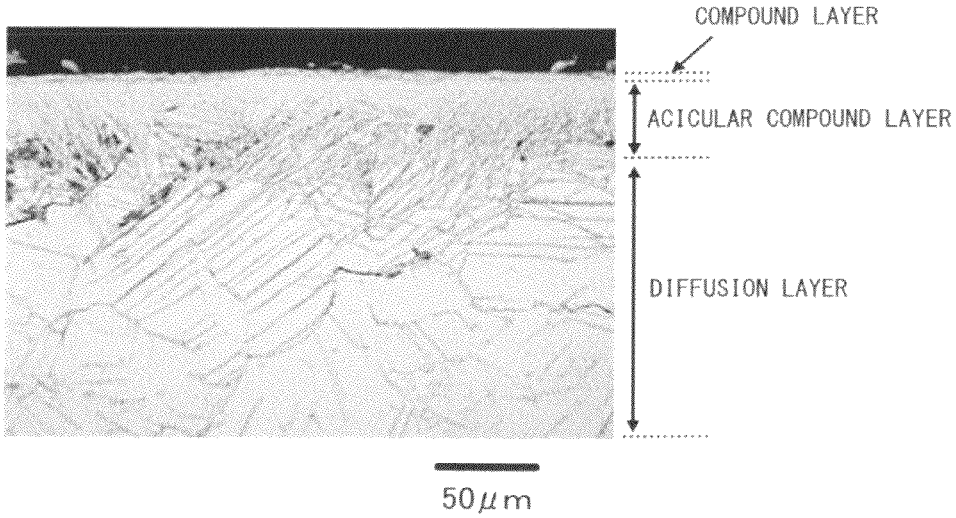
FIG. 2B is a microscope photograph showing an example of the cross-sectional microstructure of the surface layer portion in a steel part in which acicular compounds are generated.

In the nitrocarburized steel part of the embodiment, the length (thickness) of an acicular compound layer that is generated at the surface layer (a portion between the surface of the part and the diffusion layer) in the nitrocarburized portion needs to be 30 μm or less. Here, the acicular compound layer refers to a layer of acicular coarse compounds which have a morphology of protruding toward the diffusion layer from the compound layer on the surface of the nitrocarburized steel part and are continuously generated from the compound layer. When such acicular coarse compounds are present, fatigue characteristics are significantly degraded, and therefore it is supposed to prevent the generation of the acicular compound layer or decompose the generated acicular compound layer by a method of heat treatment or the like. FIG. 2A is a microscope photograph showing an example of the microstructure of a steel part after an ordinary nitrocarburizing, and FIG. 2B is a microscope photograph showing an example of the microstructure of a steel part in which acicular compounds are generated. The acicular precipitates generated in the diffusion layer (the matrix inside the compound layer at the surface) in FIG. 2A are $Fe_4N$, which does not form a layer and has no influence on fatigue characteristics so that $Fe_4N$ is not included in the acicular compound layer. The layer of acicular compounds which is harmful to fatigue characteristics is, as shown in FIG. 2B, the layer of acicular coarse compounds continuously generated from the compound layer. When the thickness (the length in the depth direction) of the acicular coarse compound layer exceeds 30 μm, fatigue characteristics are significantly degraded. Therefore, when the acicular compound layer is present, the thickness of the acicular compound layer needs to be 30 μm or less. The acicular compound layer is desirably as thin as possible. Particularly, in order to improve fatigue characteristics, the thickness of the acicular compound layer is preferably 15 μm or less. In addition, the acicular compound layer is desirably so thin as to be not observable with an optical microscope, and does not need to be present. Therefore, the lower limit of the thickness of the acicular compound layer is 0 μm.

Next, the reasons of the limitations in the producing method of the nitrocarburized steel part according to an embodiment of the present invention will be described.

[Nitrocarburizing While Holding for 60 Minutes or Longer at 550° C. to 650° C. after Forming in a Desired Part Shape]

In the embodiment, nitrocarburizing is performed after the steel for nitrocarburizing according to the above embodiment is processed into a desired part shape using, for example, hot forming, cold forming, cutting, or a combined process thereof. Ordinary nitrocarburizing is performed at a treatment temperature of about 400° C. to 580° C. When the treatment temperature is set to be high, the diffusion of nitrogen is accelerated in the diffusion layer so as to obtain a thick hardened layer, and, at the same time, the generation of the cluster of Ti and N or TiN is accelerated so as to obtain a hard hardened layer. Therefore, in the embodiment, it is necessary to set the treatment temperature of the nitrocarburizing to 550° C. or higher. In addition, when the treatment time does not last 60 minutes, it is not possible to obtain a sufficient depth of the hardened layer. When the treatment temperature of the nitrocarburizing exceeds 650° C., in the case of ordinary types of steel, since the concentration of nitrogen in the surface layer is high, the microstructure in the surface layer turns into austenite, and the hardness is conversely reduced. However, in the case of types of steel containing a large amount of solute Ti as in the above embodiment, since Ti fixes (stabilizes) nitrogen (solute nitrogen), it is possible to perform a treatment at a temperature higher than usual. When the treatment temperature is too high, since not only does the microstructure turn into austenite, but also the thickness of the compound layer generated in the outermost surface layer becomes excessive, or acicular compounds as described above protrude toward the diffusion layer from the compound layer, and the acicular compound layer harmfully affects fatigue characteristics. Therefore, it is necessary to set the treatment temperature in a range of 550° C. to 650° C. In order to obtain a harder and deeper hardened layer, the treatment temperature is preferably 560° C. or higher, and is more preferably 570° C. or higher. In addition, in order to further improve dimensional accuracy and fatigue characteristics, the treatment temperature is preferably 640° C. or lower, and is more preferably 630° C. or lower. Moreover, in order to further secure the depth of the hardened layer, the treatment time is preferably 120 minutes or longer, and is more preferably 180 minutes or longer. Since the effect of securing the depth of the hardened layer is saturated at 360 minutes, the treatment time is preferably 360 minutes or shorter.

Meanwhile, the method of nitrocarburizing may be gas nitrocarburizing, in which an atmosphere containing ammonia gas and $CO_2$ or a converted gas of hydrocarbon, such as RX gas, as the main gas, is used, salt-bath nitrocarburizing, or plasma (ion) nitriding. Alternately, sulphonitriding or oxynitriding, which are variations of the above methods, may be combined into nitrocarburizing.

[Holding for 5 Minutes or Longer in 580° C. to 700° C. in an Atmosphere Other than the Nitriding Atmosphere after Nitrocarburizing]

When it is necessary to further increase the depth of the hardened layer or improve the microstructure in the nitrocarburized portion, it is preferable to hold the part for 5 minutes or longer in 580° C. to 700° C. (heating and holding) in an atmosphere other than the nitriding atmosphere after nitrocarburizing.

Figure 2C:
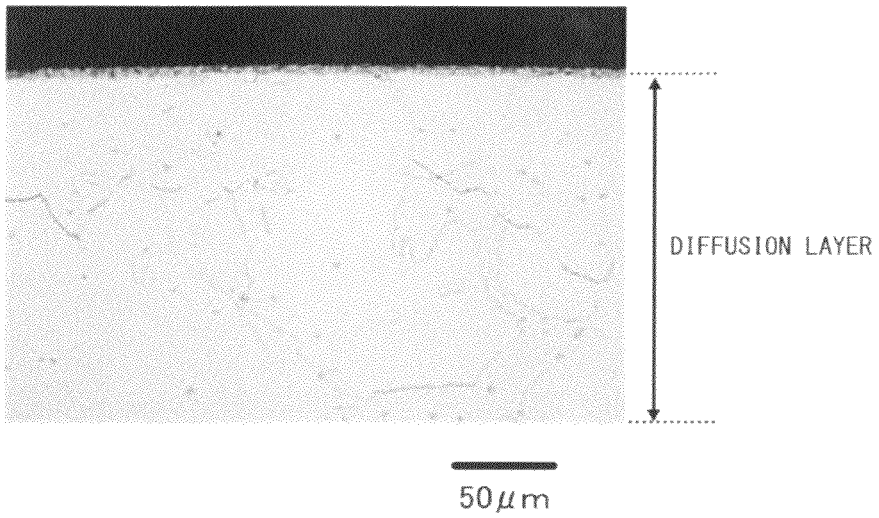
FIG. 2C is a microscope photograph showing an example of the cross-sectional microstructure of the surface layer portion in a steel part when the product has been heated and held in an atmosphere other than the nitriding atmosphere after nitrocarburizing.

That is, since heating after nitrocarburizing makes nitrogen diffuse inward, it is possible to further increase the depth of the hardened layer. In addition, since heating is performed in an atmosphere other than the nitriding atmosphere, the compound layer generated on the outermost surface layer during nitrocarburizing acts as the source of nitrogen, additional nitrogen diffuses into steel from the compound layer so as to contribute to the formation of the diffusion layer. Furthermore, at the same time, since a thick compound layer and an acicular compound layer, generated by nitrocarburizing at a high temperature, are decomposed, it is possible to improve the properties of the surface layer of a part and to improve the fatigue strength. Therefore, it is necessary to set the heating temperature to 580° C. or higher. In addition, when the heating time does not last 5 minutes, the above effect cannot be sufficiently obtained. In addition, when the heating temperature exceeds 700° C., there are cases in which the microstructure on the surface turns into austenite and the hardness is conversely reduced. Therefore, it is necessary to set the heating temperature in a range of 580° C. to 700° C. and to set the heating time to 5 minutes or longer. An example of the microstructure which has been subjected to such heating is shown in FIG. 2C. From the comparison between the microstructure in FIG. 2C and the microstructure in FIG. 2A, it is evident that $Fe_4N$ in the compound layer and the diffusion layer is decomposed by heating in an atmosphere other than the nitriding atmosphere. In order to further improve the properties of the surface layer of a part, the heating temperature is preferably 590° C. or higher. In addition, in order to more reliably secure the dimensional accuracy and the hardness, the heating temperature is preferably 680° C. or lower, and is more preferably 650° C. or lower. Furthermore, in order to more reliably obtain the effect of heating, the heating time is preferably 10 minutes or longer. Since the effect of heating is saturated in 150 minutes, the heating time is preferably 150 minutes or shorter.

Meanwhile, the heating method is not particularly limited. For example, subsequent to nitrocarburizing, heating (or holding) may be performed without cooling, or heating may be performed again after a certain degree of cooling. Naturally, heating may be performed again after the part is once cooled to room temperature. In addition, in order to obtain the same results as above, heating may be repeated several times.

Examples of the "atmosphere other than the nitriding atmosphere" may include a gaseous atmosphere, such as the atmosphere of air, nitrogen, argon, a converted gas (a RX gas or a DX gas), or a mixed gas thereof, or an atmosphere in a liquid, such as oil, salt, or lead. Meanwhile, when heating is performed in the same furnace subsequent to the gas nitrocarburizing, there are cases in which a small amount of ammonia is mixed into the gas. However, when the concentration of ammonia (or nitriding potential) in the furnace does not reach the nitrocarburizing atmosphere, the atmosphere in the furnace is evaluated as an atmosphere other than the nitriding atmosphere. With regard to cooling immediately after nitrocarburizing, any of oil cooling, water cooling, air cooling, furnace cooling, or gas cooling may be employed. In addition, with regard to cooling performed after the process in which heating is performed in 580° C. to 700° C. for 5 minutes or longer in an atmosphere other than the nitriding atmosphere after nitrocarburizing, any of oil cooling, water cooling, air cooling, furnace cooling, or gas cooling may be employed.

In the steel for nitrocarburizing and the nitrocarburized steel part according to the above embodiments, no microstructure in steel is specified. However, when forming and heat treatment (for example, hot forging, normalizing, or annealing) are performed using steel having the chemical composition of the above embodiments, the steel for nitrocarburizing and the nitrocarburized steel part include a microstructure having ferrite mainly (for example, 90% to 100% of ferrite) in the non-nitrocarburized portion. There are cases in which the ferrite includes granular cementite or a small amount of pearlite, and precipitates, such as TiN, TiC, Ti(CN), MnS, or Ti carbo-sulfide, are dispersed.

EXAMPLES

Hereinafter, the present invention will be further described with reference to examples.

On steels having the chemical compositions shown in Table 1, which had been melted in a converter, continuous casting, and, according to necessity, a soaking diffusion treatment and blooming were performed so as to manufacture 162 mm×162 mm square materials for rolling. Furthermore, hot rolling was performed on the materials for rolling so as to manufacture steel bars (hot-rolled steels) having a diameter of 35 mm. Values underlined in Table 1 indicate that they fail to satisfy the ranges of the chemical composition according to the present invention.

TABLE 1

| Steel | Chemical element (mass %) | | | | | | | | | | | |
|---|---|---|---|---|---|---|---|---|---|---|---|---|
| No. | C | Si | Mn | P | S | Cr | Mo | Ni | Cu | V | Ti | Nb |
| A | 0.051 | 0.05 | 0.30 | 0.006 | 0.004 | 0.01 | — | 0.05 | 0.05 | — | 0.802 | — |
| B | 0.048 | 0.05 | 0.30 | 0.006 | 0.004 | — | — | — | — | — | 0.904 | — |
| C | 0.010 | 0.04 | 0.50 | 0.007 | 0.006 | 0.05 | — | — | — | — | 0.796 | — |
| D | 0.026 | 0.04 | 0.29 | 0.007 | 0.004 | — | — | — | — | — | 0.769 | — |
| E | 0.001 | 0.04 | 0.29 | 0.007 | 0.006 | — | 0.60 | — | — | 0.30 | 0.512 | — |
| F | 0.055 | 0.04 | 0.29 | 0.020 | 0.006 | — | 1.00 | — | — | — | 0.902 | — |
| G | 0.015 | 0.05 | 0.29 | 0.007 | 0.004 | 0.11 | — | 1.00 | 2.00 | — | 0.777 | — |
| H | 0.042 | 0.05 | 0.30 | 0.006 | 0.014 | — | — | — | — | 0.50 | 0.785 | — |
| I | 0.039 | 0.05 | 0.29 | 0.006 | 0.004 | — | — | — | — | — | 0.878 | — |
| J | 0.149 | 0.05 | 0.50 | 0.0001 | 0.050 | — | — | — | — | — | 1.221 | 0.100 |
| K | 0.067 | 0.50 | 0.30 | 0.010 | 0.015 | — | — | — | — | — | 1.500 | — |
| L | 0.005 | 1.00 | 1.00 | 0.008 | 0.012 | — | — | — | — | — | 0.880 | — |
| M | 0.055 | 0.05 | 0.30 | 0.005 | 0.006 | — | — | — | — | — | 1.210 | — |
| N | 0.054 | 0.25 | 0.30 | 0.006 | 0.006 | 0.03 | — | — | — | — | 0.998 | — |
| O | 0.200 | 0.05 | 0.35 | 0.015 | 0.015 | — | — | — | — | — | 1.211 | — |
| P | 0.050 | 0.05 | 0.35 | 0.010 | 0.016 | — | — | — | — | — | 0.850 | — |
| Q | 0.046 | 0.05 | 0.35 | 0.009 | 0.012 | — | — | — | — | — | 0.468 | — |

TABLE 1-continued

| | | | | | | | | | | | | |
|---|---|---|---|---|---|---|---|---|---|---|---|---|
| R | 0.022 | 0.05 | 0.35 | 0.013 | 0.008 | — | — | — | — | — | 1.560 | — |
| S | 0.002 | 0.05 | 0.35 | 0.006 | 0.016 | — | — | — | — | — | 1.282 | — |
| T | 0.056 | 0.05 | 0.35 | 0.009 | 0.019 | 0.30 | — | 0.04 | 0.03 | — | 0.850 | — |

| Steel | Chemical element (mass %) | | | | [Ti %] − 47.9 ([C %]/12 + [N %]/14 + | |
|---|---|---|---|---|---|---|
| No. | Al | B | N | O | [S %]/32) | Note |
| A | 0.005 | — | 0.0024 | 0.0025 | 0.584 | Steel |
| B | 0.013 | — | 0.0023 | 0.0034 | 0.699 | for |
| C | 0.027 | — | 0.0020 | 0.0024 | 0.740 | Example |
| D | 0.016 | — | 0.0040 | 0.0014 | 0.646 | |
| E | 0.007 | — | 0.0021 | 0.0040 | 0.492 | |
| F | 0.027 | — | 0.0036 | 0.0036 | 0.661 | |
| G | 0.008 | — | 0.0042 | 0.0013 | 0.697 | |
| H | 0.027 | — | 0.0035 | 0.0023 | 0.584 | |
| I | 0.017 | — | 0.0036 | 0.0025 | 0.704 | |
| J | 0.0001 | — | 0.0020 | 0.0013 | 0.545 | |
| K | 0.040 | — | 0.0096 | 0.0021 | 1.177 | |
| L | 0.025 | 0.0025 | 0.0060 | 0.0030 | 0.822 | |
| M | 0.034 | — | 0.0031 | 0.0007 | 0.971 | |
| N | 0.012 | — | 0.0036 | 0.0035 | 0.761 | |
| O | 0.015 | — | 0.0035 | 0.0015 | 0.378 | Steel |
| P | 0.091 | — | 0.0025 | 0.0032 | 0.618 | for |
| Q | 0.032 | — | 0.0013 | 0.0025 | 0.262 | Compara- |
| R | 0.038 | — | 0.0037 | 0.0009 | 1.448 | tive |
| S | 0.011 | — | 0.0020 | 0.0008 | 1.243 | Example |
| T | 0.029 | — | 0.0056 | 0.0018 | 0.579 | |

"—" for each chemical element means that the chemical element was not added to steel.

Values underlined in this Table indicate they fail to satisfy the conditions of the chemical composition according to the present invention.

Next, in order to simulate the manufacturing process (heat history) of gears, the simulation of hot forging was performed under a condition in which the hot-rolled steels were heated at 1250° C. for 30 minutes and then were cooled in the air, and, subsequently, normalizing was performed under a condition in which the steels were heated at 925° C. for 60 minutes and then were slowly cooled. From the steels manufactured in the above manner, 20 test pieces for roller pitting test, which have a diameter of 26ϕ at the large diameter portion (testing portion), and 20 uniform gauge test pieces for Ono-type rotating bending fatigue test, which have a diameter of 8 ϕ at the uniform gauge portion, were prepared through machining.

Figure 1B:
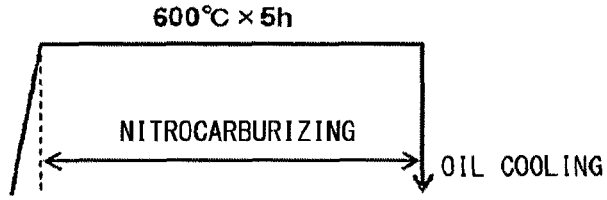
FIG. 1B is a view showing the conditions of a nitrocarburizing in an example.
Figure 1C:
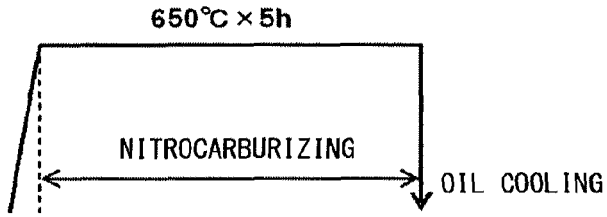
FIG. 1C is a view showing the conditions of a nitrocarburizing in an example.
Figure 1D:
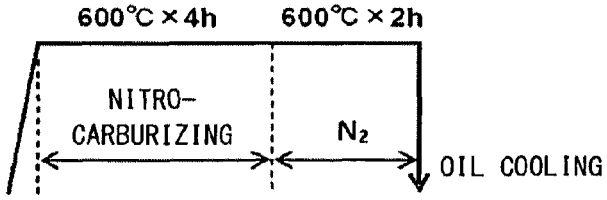
FIG. 1D is a view showing the conditions of a nitrocarburizing and heating and holding after the nitrocarburizing in an example.
Figure 1E:
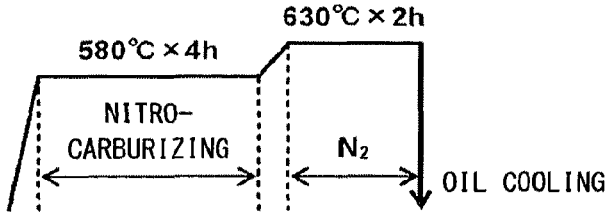
FIG. 1E is a view showing the conditions of a nitrocarburizing and heating and holding after the nitrocarburizing in an example.
Figure 1F:
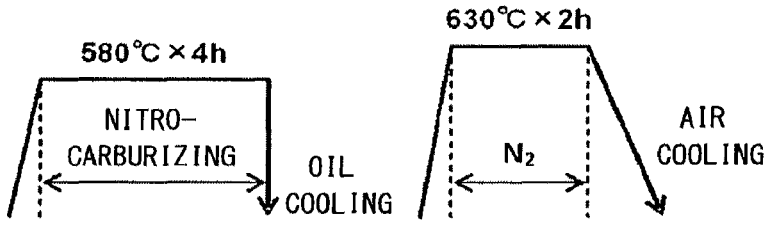
FIG. 1F is a view showing the conditions of a nitrocarburizing and heating and holding after the nitrocarburizing in an example.
Figure 1G:
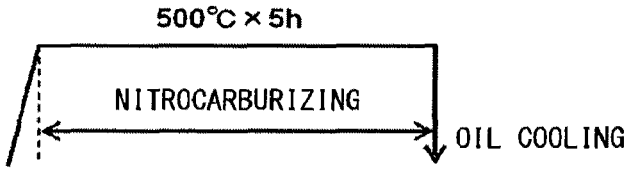
FIG. 1G is a view showing the conditions of a nitrocarburizing in a comparative example.
Figure 1H:
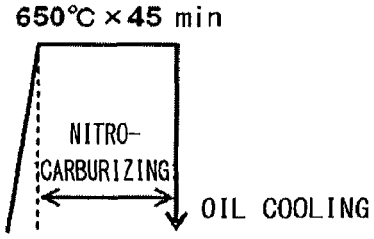
FIG. 1H is a view showing the conditions of a nitrocarburizing in a comparative example.
Figure 1I:
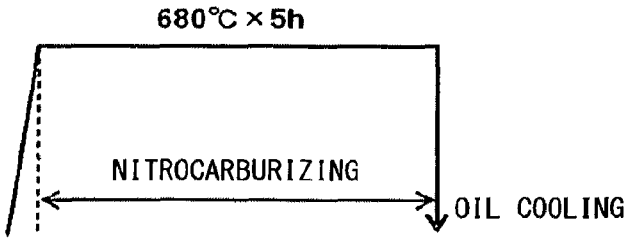
FIG. 1I is a view showing the conditions of a nitrocarburizing in a comparative example.

On the prepared test specimens, heat treatments including gas nitrocarburizing in the patterns of FIGS. 1A to 1I were performed. Particularly, in FIGS. 1D to 1F, heating and holding in an atmosphere other than the nitriding atmosphere were performed after gas nitrocarburizing. Meanwhile, in the atmosphere for gas nitrocarburizing, a mixed gas having a composition of $NH_3$:$N_2$:$CO_2$=50:45:5 was used. Here, FIGS. 1A to 1F are treatment patterns satisfying the above conditions of gas nitrocarburizing, and FIGS. 1G to 1I are treatment patterns not satisfying the above conditions of gas nitrocarburizing. Subsequently, in order to improve the test accuracy of the fatigue tests, finishing was performed on the grips of the test pieces for roller pitting test and the uniform gauge test pieces for Ono-type rotating bending fatigue test.

Among the test pieces for roller pitting test on each of the testing levels, the large diameter portion of one test piece was cut, and the microstructure on the cross-section was observed. In the observation of the microstructure, the cross-section was mirror-polished and nital-etched, and then an optical microscope photograph was taken at a magnification of 400 times to 1000 times, thereby observing the morphology of a compound layer. With regard to the acicular compound layer in which acicular compounds were generated in the morphology of protruding inward from the surface, the thickness of the acicular compound layer that appears thickest in the field of view was measured. When the thickness of the acicular compound layer exceeds 30 μm, the acicular compound layer was determined as "present." In addition, when the thickness of the acicular compound layer was 30 μm or less, the acicular compound layer was determined to be "absent." Examples of the observation of the acicular compound layer are shown in FIGS. 2A to 2C. In addition, the distribution of Vickers hardness was measured every 50 μm-pitch in the depth direction from the position 50 μm away from the surface (a depth of 50 μm). Furthermore, in the vicinity of the boundary between the hardened layer (diffusion layer) and the non-hardened layer (non-nitrocarburized portion), a location where the hardness HV became 550 (that is, a depth where a hardness HV of 550 or larger could be obtained in the hardened layer) was obtained. Hereinafter, the hardness at a depth of 50 μm will be referred to as "the hardness of the surface layer," and the position where the hardness HV becomes 550 will be referred to as "the effective depth of the hardened layer." Here, when the hardness HV of the surface layer failed to reach 600, and when the effective depth of the hardened layer failed to reach 0.40 mm, the hardness of the surface layer and the effective depth of the hardened layer were determined respectively as failing to achieve the target value.

In the roller pitting test, carburized steel SCM420 with crowning 150R was used as the large roller, and transmission oil with an oil temperature of 80° C. was used as the lubricant oil. In addition, the specific sliding was set to −40%, and the large roller was rotated at a rotation speed of 2000 rpm a maximum of 10 million times. The roller pitting test was performed under these conditions, and S—N diagrams were drawn to obtain fatigue limits, thereby evaluating the roller pitting fatigue strength. When the roller pitting fatigue strength failed to reach 2600 MPa, the fatigue strength at the tooth flank was determined to be poor. In addition, the Ono-type rotating bending fatigue test using uniform gauge test pieces was performed at a rotation speed of 3000 rpm, and S—N diagrams were drawn to obtain fatigue limits, thereby evaluating the rotating bending fatigue strength. When the rotating bending fatigue strength failed to reach 550 MPa, the bending fatigue strength at the dedendum was determined to be poor.

The evaluation results are shown in Table 2. In the examples of Manufacturing Nos. 1 to 19, since the hardness of the surface layer and the effective depth of the hardened layer were sufficient, the fatigue strength at the tooth flank and the rotating bending fatigue strength were also sufficient.

TABLE 2

| Manufacturing No. | Steel No. | Pattern of nitrocarburizing | Hardness of surface layer HV | Effective depth of hardened layer mm | Acicular compound layer | Roller pitting fatigue strength MPa | Rotating bending fatigue strength MPa | Note |
|---|---|---|---|---|---|---|---|---|
| 1 | A | FIG. 1A | 788 | 0.65 | Absent | 2900 | 620 | Example |
| 2 | A | FIG. 1B | 812 | 0.79 | Absent | 2880 | 640 | |
| 3 | A | FIG. 1C | 833 | 0.88 | Absent | 2950 | 680 | |
| 4 | A | FIG. 1D | 801 | 0.69 | Absent | 2900 | 640 | |
| 5 | A | FIG. 1E | 797 | 0.74 | Absent | 2840 | 660 | |
| 6 | A | FIG. 1F | 792 | 0.75 | Absent | 2800 | 670 | |
| 7 | B | FIG. 1B | 825 | 0.69 | Absent | 2980 | 630 | |
| 8 | C | FIG. 1B | 833 | 0.67 | Absent | 3030 | 640 | |
| 9 | D | FIG. 1B | 801 | 0.70 | Absent | 2810 | 650 | |
| 10 | E | FIG. 1B | 774 | 0.67 | Absent | 2760 | 640 | |
| 11 | F | FIG. 1B | 806 | 0.71 | Absent | 2890 | 660 | |
| 12 | G | FIG. 1B | 809 | 0.70 | Absent | 2820 | 640 | |
| 13 | H | FIG. 1B | 801 | 0.72 | Absent | 2820 | 650 | |
| 14 | I | FIG. 1B | 811 | 0.76 | Absent | 2930 | 670 | |
| 15 | J | FIG. 1B | 784 | 0.71 | Absent | 2710 | 660 | |
| 16 | K | FIG. 1B | 988 | 0.60 | Absent | 3350 | 630 | |
| 17 | L | FIG. 1B | 871 | 0.64 | Absent | 3060 | 620 | |
| 18 | M | FIG. 1B | 997 | 0.62 | Absent | 3130 | 660 | |
| 19 | N | FIG. 1B | 817 | 0.65 | Absent | 2920 | 640 | |
| 20 | A | FIG. 1G | 691 | 0.33 | Absent | 2600 | 490 | Comparative |
| 21 | A | FIG. 1H | 767 | 0.37 | Absent | 2690 | 540 | Example |
| 22 | A | FIG. 1I | 777 | 0.98 | Present | <2000 | 320 | |
| 23 | O | FIG. 1B | 588 | 0.94 | Absent | <2000 | 560 | |
| 24 | P | FIG. 1B | 1003 | 0.34 | Absent | 2770 | 540 | |
| 25 | Q | FIG. 1B | 388 | — | Absent | <2000 | 400 | |
| 26 | R | FIG. 1B | 1134 | 0.23 | Absent | 2600 | 390 | |
| 27 | S | FIG. 1B | 1099 | 0.38 | Absent | 2620 | 410 | |
| 28 | T | FIG. 1B | 967 | 0.39 | Absent | 2800 | 490 | |

Values underlined in this Table indicate they fail to satisfy the conditions according to the present invention.
"—" in this Table means that no depth where hardness HV reaches 550 is present.

On the other hand, since the nitrocarburizing temperature was low in Manufacturing No. 20, the effective depth of the hardened layer was thin, and the rotating bending fatigue strength was insufficient. The nitrocarburizing time was too short in Manufacturing No. 21, and therefore the effective depth of the hardened layer was thin, and the rotating bending fatigue strength was insufficient. Since the nitrocarburizing temperature was too high in Manufacturing No. 22, a large effective depth of the hardened layer was obtained, but an acicular compound layer was generated in the surface layer such that both the roller pitting fatigue strength and the rotating bending fatigue strength were significantly lowered. In Manufacturing No. 23, since the added amount of C was too large, it was not possible to secure a predetermined amount of solute Ti ([Ti %]−47.9×([C %]/12+[N %]/14+[S %]/32) although a large amount of Ti was added to steel. As a result, in Manufacturing No. 23, the hardness of the surface layer was low, and the roller pitting fatigue strength was insufficient. In Manufacturing No. 24, since the added amount of Al was too large, a large amount of AlN was generated in the surface layer so that the hardness of the surface layer increased, but the depth of the hardened layer became thinner, and therefore the rotating bending fatigue strength was insufficient. Since the added amount of Ti was too small in Manufacturing No. 25, it was not possible to secure a predetermined amount of solute Ti such that the hardness of the surface layer became low, and the roller pitting fatigue strength was insufficient. In Manufacturing No. 26, since the added amount of Ti was too large, the hardness of the surface layer was extremely large, but the effective depth of the hardened layer became thin, and the rotating bending fatigue strength was insufficient. Since the amount of solute Ti was 1.2% or more in Manufacturing No. 27, the hardness of the surface layer was extremely large, but the effective depth of the hardened layer became thin, and the rotating bending fatigue strength was insufficient. In Manufacturing No. 28, since the added amount of Cr is too large, a large amount of CrN was generated in the surface layer so that the hardness of the surface layer increased, but the depth of the hardened layer became thin, and the rotating bending fatigue strength was insufficient.

Figure 3:
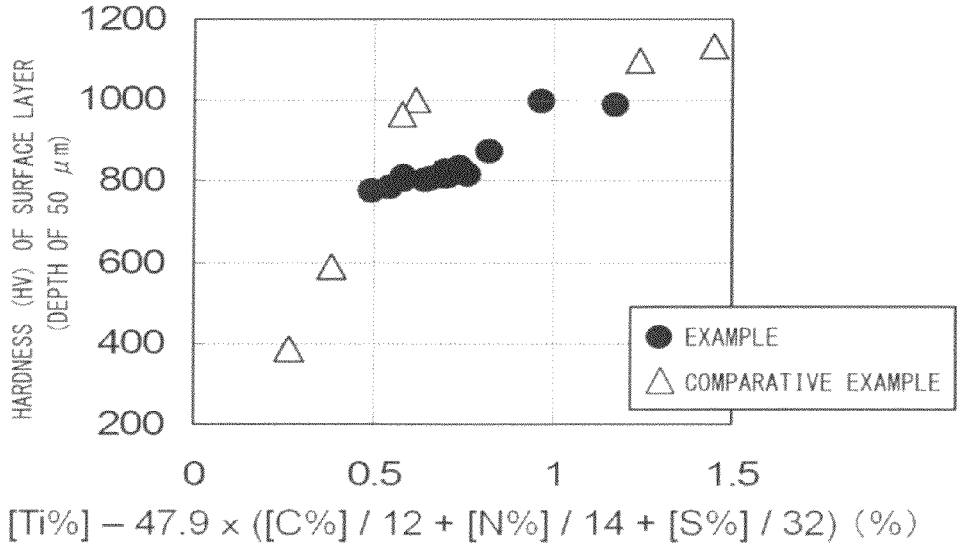
FIG. 3 is a diagram showing the relationship between the amount of the solute Ti and the hardness of the surface layer when the treatment of FIG. 1B is performed.

FIG. 3 shows the relationship between the amount of solute Ti and the hardness of the surface layer when the treatment of FIG. 1B is performed. It is evident from FIG. 3 that a higher hardness of the surface layer can be obtained as the amount of solute Ti increases.

Figure 4:
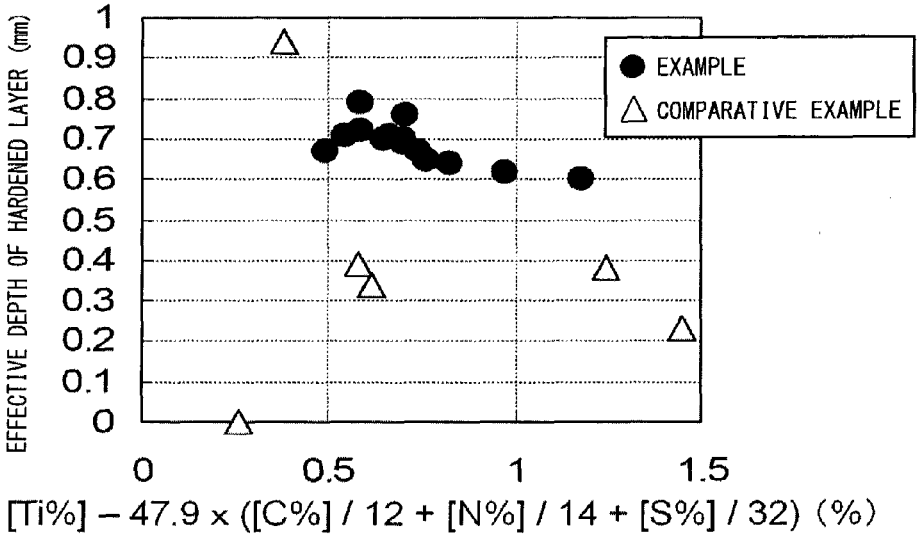
FIG. 4 is a diagram showing the relationship between the amount of the solute Ti and the effective depth of the hardened layer (effective case depth) when the treatment of FIG. 1B is performed.

FIG. 4 shows the relationship between the amount of solute Ti and the effective depth of the hardened layer. It is evident from FIG. 4 that, basically, the effective depth of the hardened layer becomes thinner as the amount of solute Ti increases. However, since chemical elements other than solute Ti (particularly Al and Cr) also have a large influence, it is difficult to determine the effective depth of the hardened layer by only the amount of solute Ti. Therefore, the upper limits of the amounts of Al and Cr are important in order to sufficiently secure the effective depth of the hardened layer. For example, it is evident from the comparison between Manufacturing No. 2 and Manufacturing No. 12 that it is possible to further improve the effective depth of the hardened layer by limiting the amount of Cr even when the amount of solute Ti is small.

Particularly, when the amount of solute Ti is small, it is desirable to limit the added amounts of Al and Cr.

Figure 5:
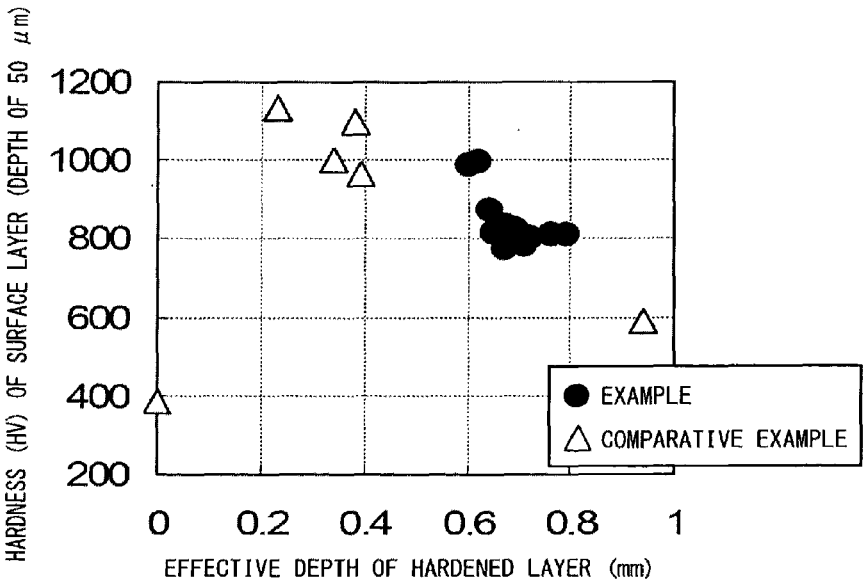
FIG. 5 is a diagram showing the relationship between the effective depth of the hardened layer and the hardness of the surface layer when the treatment of FIG. 1B is performed.

FIG. 5 shows the relationship between the effective depth of the hardened layer and the hardness of the surface layer. It is evident that all of the examples satisfy the above targets.

INDUSTRIAL APPLICABILITY

It is possible to provide steel for nitrocarburizing which can obtain the hardness and depth of a hardened layer, which are comparable to those of a carburized part, after nitrocarburizing so as to replace a carburized part, and can obtain a surface-hardened steel part which shows extremely small heat treatment-induced deformation in comparison to a carburized part, a nitrocarburized steel part, and a producing method thereof.

What is claimed is:

1. A steel for nitrocarburizing, consisting of, by mass %:

C: 0% to 0.067%;

Si: 0.01% to 1.00%;

Mn: 0.29% to 1.00%;

S: 0.0001% to 0.050%;

Al: 0.0001% to 0.050%;

Ti: more than 0.50% to 1.50%;

N: 0.0005% to 0.0100%; and a balance consisting of Fe and inevitable impurities, wherein P is limited to 0.050% or less;

O is limited to 0.0060% or less; and an amount of Ti [Ti %], an amount of C [C %], an amount of N [N %], and an amount of S [S %] satisfy $0.48<[Ti\ \%]-47.9\times([C\ \%]/12+[N\ \%]/14+[S\ \%]/32)\leq 1.20$.

2. The steel for nitrocarburizing according to claim 1, wherein the amount of Ti [Ti] is 0.60% to 1.50%.

3. A steel for nitrocarburizing, consisting of, by mass %:

C: 0% to 0.067%;

Si: 0.01% to 1.00%;

Mn: 0.29% to 1.00%;

S: 0.0001% to 0.050%;

Al: 0.0001% to 0.050%;

Ti: more than 0.50% to 1.50%;

N: 0.0005% to 0.0100%;

at least one of

Cr: 0.01% to less than 0.30%;

Mo: 0.01% to 1.00%;

V: 0.005% to 0.50%;

Nb: 0.005% to 0.10%;

Cu: 0.05% to 2.00%;

Ni: 0.05% to less than 2.00%; or

B: 0.0005% to 0.0050%; and a balance consisting of Fe and inevitable impurities, wherein P is limited to 0.050% or less;

O is limited to 0.0060% or less; and an amount of Ti [Ti %], an amount of C [C %], an amount of N [N %], and an amount of S [S %] satisfy $0.48<[Ti\ \%]-47.9\times([C\ \%]/12+[N\ \%]/14+[S\ \%]/32)\leq 1.20$.

4. The steel for nitrocarburizing according to claim 3, wherein the amount of Ti [Ti] is 0.60% to 1.50%.

* * * * *